US006529664B1

(12) United States Patent
Deason

(10) Patent No.: US 6,529,664 B1
(45) Date of Patent: Mar. 4, 2003

(54) METHOD AND APPARATUS FOR INSTALLING IN SWIMMING POOL A TRACK FOR RECEIVING OPTICAL FIBERS

(76) Inventor: Ted E. Deason, 1960 North Box Canyon Pl., Tucson, AZ (US) 85745

( * ) Notice: Subject to any disclaimer, the term of this patent is extended or adjusted under 35 U.S.C. 154(b) by 0 days.

(21) Appl. No.: 09/704,377

(22) Filed: Nov. 2, 2000

(51) Int. Cl.[7] ..... G02B 6/04

(52) U.S. Cl. ..... 385/115; 362/581; 4/496; 156/245; 249/9

(58) Field of Search ..... 385/115; 362/581, 362/562; 4/496; 156/245; 249/10

(56) References Cited

U.S. PATENT DOCUMENTS 4,387,877 A * 6/1983 Deason ..... 249/10
4,395,014 A * 7/1983 Deason ..... 249/10
5,170,517 A * 12/1992 Stegmeier ..... 4/496
5,695,586 A * 12/1997 Stegmeier ..... 156/245

* cited by examiner

*Primary Examiner*—Brian Sircus
*Assistant Examiner*—Brian S. Webb
(74) *Attorney, Agent, or Firm*—Tod R. Nissle, P.C.

(57) ABSTRACT

A method and apparatus mounts one or more optical fibers in a channel in a track along the periphery of a pool. The method and apparatus prevent slurry from entering the channel during the construction of a coping along the pool periphery. The track is mounted in the coping.

6 Claims, 5 Drawing Sheets

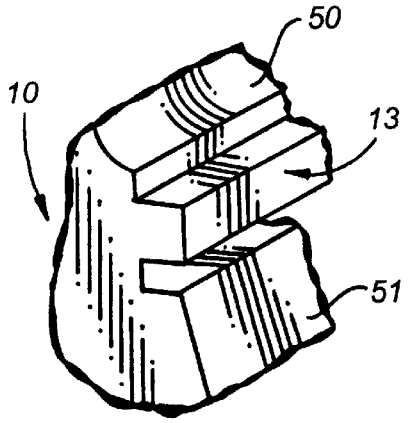
FIG. 1A
FIG. 2
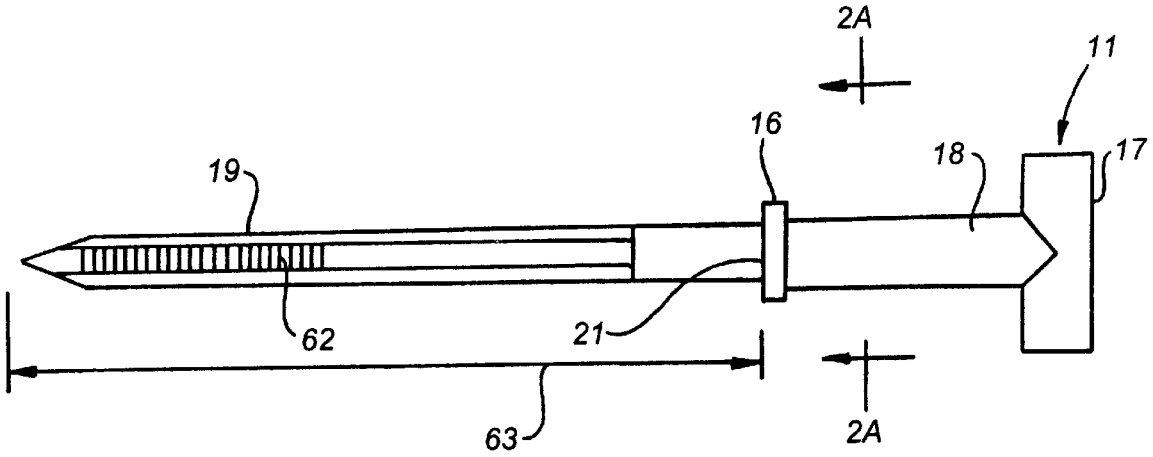

METHOD AND APPARATUS FOR INSTALLING IN SWIMMING POOL A TRACK FOR RECEIVING OPTICAL FIBERS

This invention pertains to a method and apparatus for mounting one or more optical fibers in apparatus for supporting or securing the optical fibers in a selected position and orientation.

More particularly, this invention pertains to a method and apparatus for mounting one or more optical fibers along an edge of a pool of liquid.

In a further respect, the invention pertains to a method and apparatus for mounting along the periphery of a swimming pool a fiber optic track to receive a bundle of optical fibers and to secure the bundle in a selected position at the pool periphery.

Unitary tracks for receiving a bundle of optical fibers are well known. Such tracks can be installed while concrete slurry is molded or shaped to produce the coping or edge of a swimming pool. The tracks typically each include anchor legs or feet that extend into the concrete slurry and that, once the slurry hardens, prevent the track from being removed from the concrete. Each track includes a U-shaped channel. The channel includes a pair of spaced apart, outwardly extending, flexible, elastic arms. When a bundle of optical fibers is pressed into the U-shaped channel, the bundle initially elastically forces the flexible arms apart. Once the bundle of optical fibers is completely pressed into the channel, the flexible arms elastically snap back to their original position to retain the bundle of optical fibers in the U-shaped channel. One problem encountered during the installation of tracks in wet concrete slurry is that portions of slurry tend to flow or fall into the U-shaped channel and harden, making it difficult to clean the hardened concrete from the channel and use channel to receive a bundle of optical fibers.

Accordingly, it would be highly desirable to provide an improved method and apparatus which would prevent concrete slurry from collecting inside a track during installation of the track in the periphery of a swimming pool.

Therefore, it is a principal object of the instant invention to provide an improved method and apparatus for constructing the peripheral edge of a pool of liquid.

Another object of the invention is to provide an improved method and apparatus for installing a mounting track in the periphery of a pool.

A further object of the invention is to provide an improved method and apparatus for mounting a bundle of optical fibers at the edge of a pool.

The foregoing and other, further and more specific objects and advantages of the invention will be apparent from the following detailed description of the invention, taken in conjunction with the drawings, in which:

FIG. 1A is a perspective view illustrating construction details of a portion of the foam form 10 of FIG. 1;

FIG. 2 is a side view illustrating an anchor utilized in the apparatus of FIG. 1;

Briefly, in accordance with the invention, I provide an improved method for mounting a track along the periphery of a pool of water. The track includes a mounting channel shaped and dimensioned to receive a bundle of optical fibers. The improved method includes the steps of providing a form, the form including a portion shaped and dimensioned to fit sealingly in the mounting channel; securing the track on the form such that the portion fits sealingly in the mounting channel; pouring a slurry against the form; allowing the slurry to harden; and, separating the form from the hardened slurry such that the portion is removed from the mounting channel.

In other embodiment of the invention, I provide apparatus for forming along the periphery of a pool a system for mounting a bundle of optical fibers. The apparatus includes a form including an elongate sealing portion; and, an elongate track mounted on the form. The track includes a plurality of spaced apart apertures formed therethrough; and, a mounting channel shaped and dimensioned to receive the bundle of optical fibers. The channel is mounted on the elongate sealing portion of the form such that the sealing portion prevents a slurry from flowing into the mounting channel. The apparatus also includes a plurality of anchor members each extending through the form and one of the apertures in the track.

Figure 1:
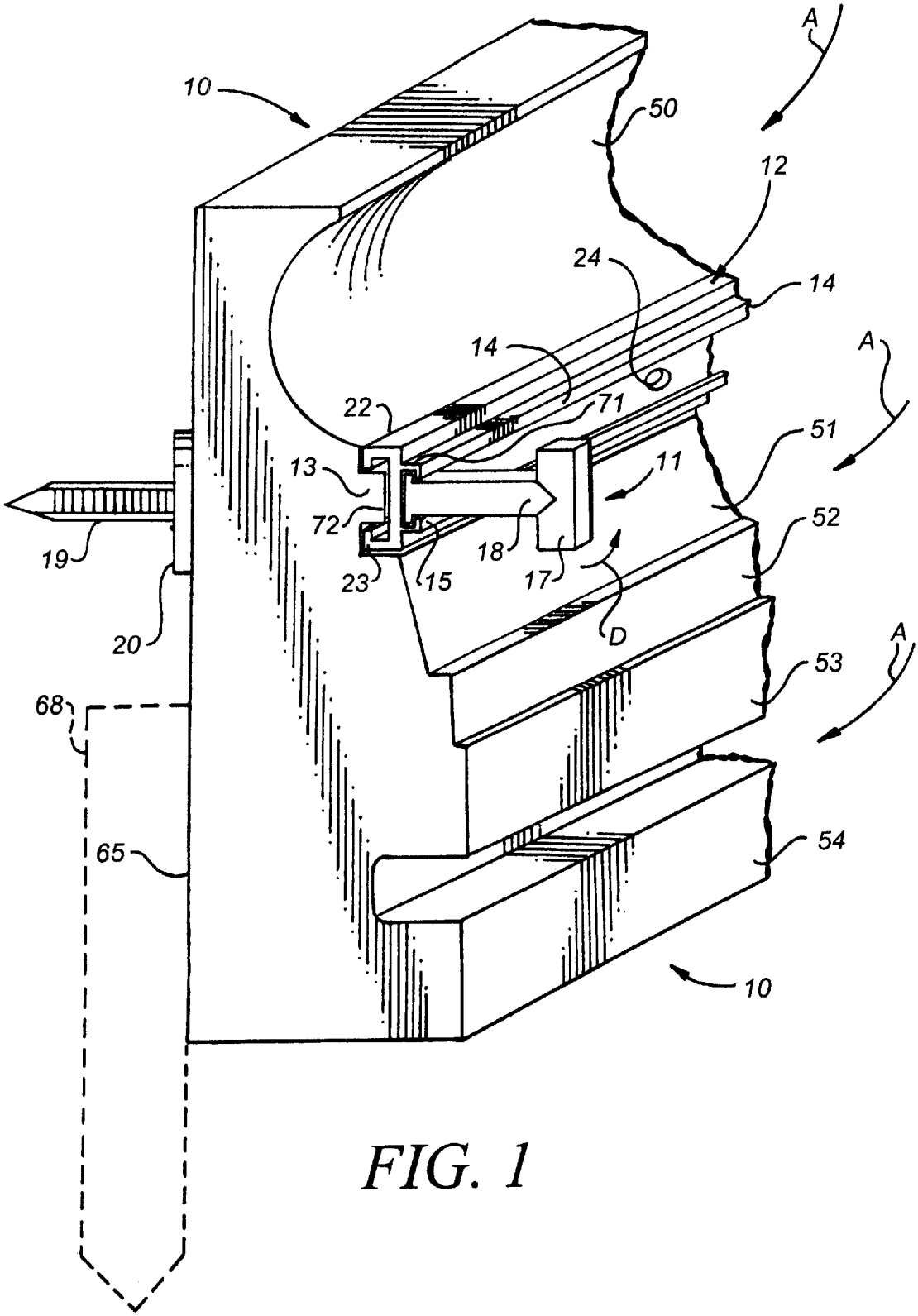
FIG. 1 is perspective view illustrating apparatus for constructing the peripheral edge of a pool of liquid in accordance with the principles of the invention.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates apparatus for forming along the periphery of a pool a system for mounting a bundle of optical fibers. The apparatus includes a foam form 10, includes an elongate track 12 mounted on the form 10, and includes a plurality of anchor:members 11 each extending through form 10 and through one of the spaced apart apertures 24 equally spaced along and through track 12.

Figure 4:
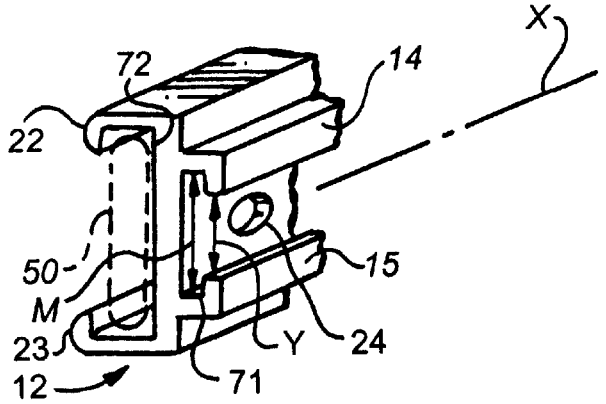
FIG. 4 is a perspective view illustrating another track which can be utilized to mount a bundle of optical fibers in accordance with the principles of the invention.

The track 12 for a rectangular or "flat" bundle of optical fibers is shown in FIG. 4. Track 12 includes apertures 24 formed therethrough at spaced apart intervals; includes opposing L-shaped fingers 14, 15; includes rectangular, flat inner face 72; and, includes opposing elastic fingers 22, 23. As indicated by dashed lines 50, fingers 22 and 23 are shaped and dimensioned to permit a flat bundle 50 of optical fibers to be snapped intermediate fingers 22 and 23 into the position in track 12 illustrated in FIG. 4.

Figure 3:
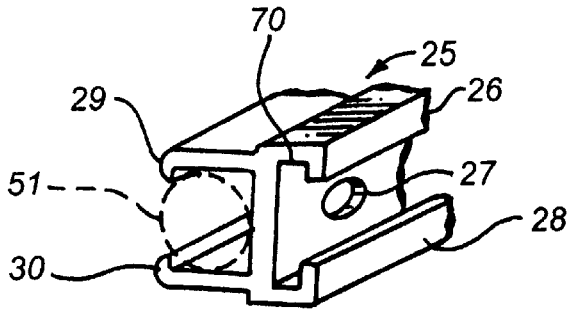
FIG. 3 is a perspective view illustrating a track which can be utilized to mount a bundle of optical fibers in accordance with the principles of the invention.

The track 25 for a round bundle 51 of optical fibers is shown in FIG. 3. Track 25 includes apertures 27 formed therethrough at spaced apart intervals; includes opposing L-shaped fingers 26, 27; and, includes opposing elastic fingers 29, 30. As indicated by dashed lines 51, fingers 29 and 30 are shaped and dimensioned to permit a round bundle 51 of optical fibers to be snapped intermediate fingers 29, 30 into the position in track 25 illustrated in FIG. 3.

Figure 2A:
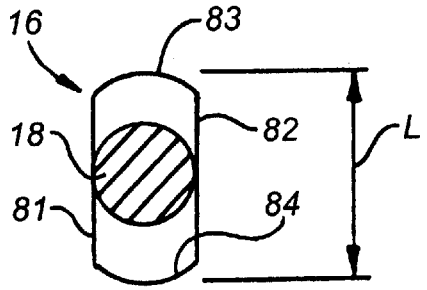
FIG. 2A is a section view of the anchor of FIG. 2 taken along section line 2A—2A thereof and further illustrating construction details thereof.

FIGS. 2 and 2A illustrate the anchor 11 used to position a light track 12, 25 on form 10 and in the peripheral edge or coping of a swimming pool. Anchor 11 includes T-head 17, neck 18, collar 16 and leg 19. Anchor 11 is frangible. Leg 19 breaks off from collar 16 at juncture 21. The collar 16 is oblong and is shaped such that it can be oriented to fit intermediate fingers 26, 28 (or 14, 15) and then turned 90 degrees to lock into the U-shaped groove 70 formed by fingers 26, 28 (or to lock into U-shaped groove 71 formed by fingers 14, 15). Fingers 26, 28 of track 25 are shown in FIG. 3. Fingers 14 and 15 of track 12 are shown in FIG. 4.

Figure 5:
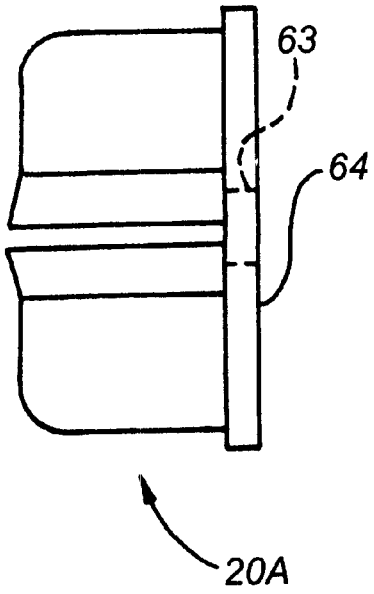
FIG. 5 is a side elevation view illustrating a button utilized to secure the anchor of FIG. 2 in a form in the manner illustrated in FIG. 1; and, FIG. 6 is a perspective view illustrating the mode of operation of the apparatus of FIGS. 1 to 5A.
Figure 5A:
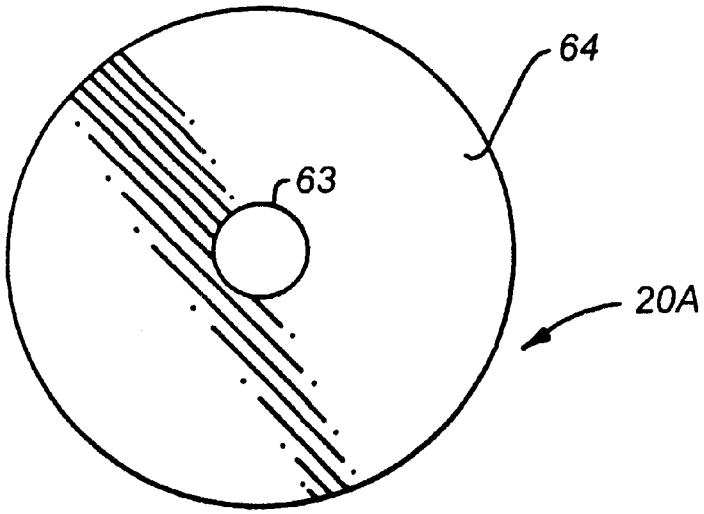

FIGS. 1 and 5 illustrate buttons 20, 20A which can be slid over leg 19 to secure anchor 11 on foam form 10. Form 10 can be constructed from any desired material. As shown in FIG. 5A, button 20A includes aperture 63 and circular face 64. When button 20A is slid over leg 19 of anchor 11, one of the serrations 62 on leg 19 interlocks with button 20A (or button 20) such that button 20A is maintained in position on leg 19 with surface 64 pressing against the back surface 65 of form 10.

Foam form 10 includes outwardly projecting elongate portion or lip 13 which extends the length of form 10. Elongate lip 13 is shaped to fit snugly and sealingly in and to be compressed between fingers 22 and 23 of a track 12 (or fingers 29 and 30 of track 25) such that concrete which is poured behind and against form in the direction of arrow A is prevented from flowing or seeping or leaking into the space between fingers 22, 23 (or fingers 29, 30). As can be seen in FIG. 1, elongate lip 13 has a rectangular cross-sectional area.

In use, during the construction of a swimming pool or other pool, foam form 10 is utilized as follows to produce the coping or edge which extends around the top of the pool.

Form 10 is fixed in position with stakes 68 or other securing means. A length of track 12 is pushed over lip 13 in the manner illustrated in FIG. 1. Lip 13 sealingly fits between fingers 22, 23 of track 12. The leg 19 of an anchor 11 is pushed through an aperture 24 in track 12, and the anchor 11 is positioned and collar 16 is oriented with edges 81, 82 (FIG. 2A) parallel to elongate fingers 14 and 15 and to axis X such that collar 16 can be pushed between fingers 14 and 15 and seated against inner face 72 of track 12. The distance from edge 81 to edge 82 is slightly less than the distance Y between edges 14, 15. Leg 19 is then pushed completely through form 10 such that collar 16 passes between fingers 14 and 15 contacts and seats against face 72. T-head 17 of anchor 11 is grasped manually or grasped with a tool, and anchor 11 is rotated ninety degrees in the direction of arrow D (FIG. 1) so that collar 16 turns through an arc of 90 degrees in track 12 to the position shown in FIG. 1. When collar 16 turns in this manner through an arc of ninety degrees, the outer ends 83, 84 of collar 16 "lock" into position in U-shaped groove 71 between L-shaped fingers 14 and 15 and face 72 (see FIG. 4 for illustration of fingers 14, 15). The length L (FIG. 2A) from end 83 to 84 is slightly less than the width M (FIG. 4) of groove 71 and is greater than the distance from edge 81 to edge 82. After collar 16 is locked in U-shaped groove 71, anchor 11 is in the position illustrated in FIG. 1. Button 20 is slipped over leg 19 and pressed against form 10 in the position shown in FIG. 1 to fix anchor 11 in the position shown in FIG. 1 and to fix track 12 in position over lip 13 in the manner illustrated in FIG. 1. An anchor 11 is selected for each of the other apertures 24 in track 12. The leg 19 of each anchor 11 which is selected for one of the remaining apertures 24 is pushed through the aperture 24 and form 10, the collar 16 is locked in groove 71, and anchor 11 is secured in form 10 with a button 20, 20A in the manner just described. The diameter of the leg 19 of an anchor 11 is slightly less than the diameter of an aperture 24 (or 27) or 63 so that leg 19 can readily slide through apertures 24, 63. Oval collar 16 is larger than and does not fit through aperture 24 (or 27).

Concrete slurry 60 or some other desired slurry composition which will harden is poured behind form 10 in the directions indicated by arrows A. After the concrete 60 hardens, form 10 is removed. During the removal of form 10, the leg 19 on each frangible anchor 11 is broken off from collar 60 at point 21 and is discarded in the manner indicated by dashed lines 19 and arrow E in FIG. 6.

Figure 6:
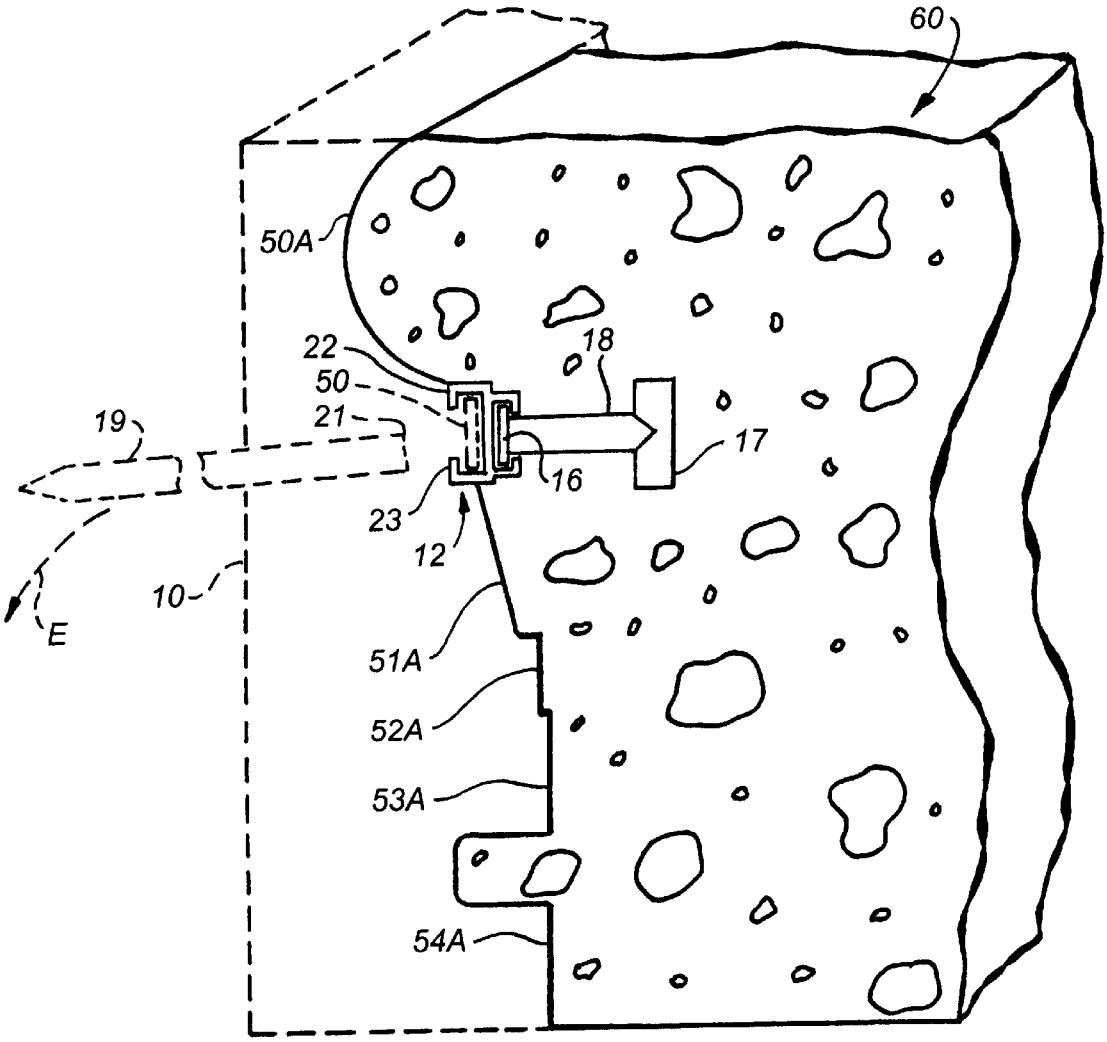

FIG. 6 illustrates hardened concrete 60 after legs 19 are broken off anchors 11 and after form 10 is removed. As shown in FIG. 6, the T-head 17, neck 18, and collar 16 of each anchor 11 remain anchored in hardened concrete along with track 12. A "flat" fiber optic bundle 50 can be snapped into position between elastic fingers 22, 23.

In FIG. 6, arcuate surface 50A is adjacent and contacts arcuate surface 50 of form 10 before form 10 is removed from hardened concrete 60; surface 51A is adjacent and contacts flat surface 51 of form 10 before form 10 is removed from hardened concrete 60; surface 52A is adjacent and contacts flat surface 52 of form 10 before form 10 is removed from hardened concrete 60; etc.

Having described my invention in such terms as to enable those of skill in the art to make and practice it, and having described the presently preferred embodiments thereof,

I claim:

1. Apparatus for forming along the periphery of a pool a system for mounting a bundle of optical fibers, said apparatus including (a) a form including an elongate sealing portion;

(b) an elongate track mounted on said form, said track including (i) a mounting channel shaped and dimensioned to receive the bundle of optical fibers, said channel having an elongate back and being mounted on said elongate sealing portion of said form such that said sealing portion prevents a slurry from flowing into said mounting channel, (ii) an elongate U-shaped groove, (iii) an elongate back common to and intermediate said channel and said groove, and (iv) a plurality of spaced apart apertures formed through said back of and opening into said channel and said groove; and, (c) a plurality of anchor members each extending through said form, said channel, said groove, and one of said apertures.

2. Apparatus for forming along the periphery of a pool a system for mounting a bundle of optical fibers, said apparatus including (a) a form including an elongate sealing portion;

(b) an elongate track mounted on said form, said track including (i) a mounting channel shaped and dimensioned to receive the bundle of optical fibers, said channel being mounted on said elongate sealing portion of said form such that said sealing portion prevents a slurry from flowing into said mounting channel, (ii) an elongate U-shaped groove, and (iv) a plurality of spaced apart apertures; and, (c) a plurality of anchor members each extending through said form, said channel, said groove, and one of said apertures and each including a collar shaped and dimensioned, when said anchor member is inserted in one of said apertures, to be inserted in said groove and turned to lock said anchor member in position such that said collar and said anchor member are prevented from being pulled out of said groove, said channel, said groove, and said aperture.

3. The apparatus of claim 2 wherein said sealing portion extends into said channel.

4. The apparatus of claim 3 wherein (a) said track includes a back intermediate said groove and said channel, and (b) said back is contacted by said sealing portion.

5. The apparatus of claim 4 wherein said apertures extend through said back.

6. Apparatus for forming along the periphery of a pool a system for mounting a bundle of optical fibers, said apparatus including (a) a form including an elongate sealing portion;

(b) an elongate track mounted on said form, said track including (i) a mounting channel shaped and dimensioned to receive the bundle of optical fibers, said channel being mounted on said elongate sealing portion of said form such that said sealing portion prevents a slurry from flowing into said mounting channel, (ii) an elongate groove, and (iv) a plurality of spaced apart apertures;

(c) a plurality of anchor members each extending through said form and including (i) a proximate end and a distal end, said proximate end including a collar inserted in said groove and turned to lock said anchor member in position such that said collar and said anchor member are prevented from being pulled out of said groove, and (ii) a distal end; and, (d) concrete extending around said distal end of each of said anchor members and contacting said form.

* * * * *